US009068391B2

(12) United States Patent
Peck et al.

(10) Patent No.: US 9,068,391 B2
(45) Date of Patent: Jun. 30, 2015

(54) ADJUSTABLE GARAGE DOOR JAMB TRIM

(71) Applicants: Robert William Peck, Cedar Rapids, IA (US); Mark William Loughren, Cedar Rapids, IA (US)

(72) Inventors: Robert William Peck, Cedar Rapids, IA (US); Mark William Loughren, Cedar Rapids, IA (US)

(73) Assignee: Marpec, Inc., Cedar Rapids, IA (US)

( * ) Notice: Subject to any disclaimer, the term of this patent is extended or adjusted under 35 U.S.C. 154(b) by 0 days.

(21) Appl. No.: 13/857,987

(22) Filed: Apr. 5, 2013

(65) Prior Publication Data

US 2013/0263536 A1 Oct. 10, 2013

Related U.S. Application Data

(60) Provisional application No. 61/620,436, filed on Apr. 5, 2012.

(51) Int. Cl.

| | |
|---|---|
| ***E06B 1/34*** | (2006.01) |
| ***E06B 1/28*** | (2006.01) |
| ***E06B 1/60*** | (2006.01) |
| *E06B 1/30* | (2006.01) |
| *E06B 1/52* | (2006.01) |

(52) U.S. Cl.

CPC ... *E06B 1/34* (2013.01); *E06B 1/28* (2013.01); *E06B 1/60* (2013.01); *E06B 1/30* (2013.01); *E06B 1/522* (2013.01)

(58) Field of Classification Search

CPC ..... E06B 1/34; E06B 1/30; E06B 1/522; E06B 1/52; E06B 1/04; E06B 1/28; E06B 1/60

USPC ..... 52/210, 211, 717.01, 656.4, 656.1, 52/656.7, 204.1; D25/124

See application file for complete search history.

(56) References Cited

U.S. PATENT DOCUMENTS

| | | | | | |
|---|---|---|---|---|---|
| 1,287,672 | A * | 12/1918 | Gogay | 52/211 |
| 3,609,928 | A * | 10/1971 | Mock | 52/210 |
| 3,974,606 | A * | 8/1976 | LaBorde | 52/288.1 |
| 5,412,909 | A * | 5/1995 | Wu | 49/505 |
| 5,758,458 | A * | 6/1998 | Ridge | 52/204.1 |
| 5,941,033 | A * | 8/1999 | Adams | 52/212 |
| 5,979,129 | A * | 11/1999 | Azar | 52/211 |
| 7,043,883 | B1 * | 5/2006 | Cederberg et al. | 52/204.1 |
| 7,627,996 | B2 * | 12/2009 | Honda | 52/211 |
| 8,347,586 | B2 * | 1/2013 | Boldt | 52/745.16 |
| 2002/0083663 | A1 * | 7/2002 | Ballantyne | 52/204.1 |
| 2007/0022699 | A1 * | 2/2007 | Wang | 52/656.4 |
| 2008/0072506 | A1 * | 3/2008 | LeGoff | 52/204.1 |
| 2010/0212239 | A1 * | 8/2010 | Wang | 52/217 |

FOREIGN PATENT DOCUMENTS

| | | | | |
|---|---|---|---|---|
| DE | 2242431 | * | 2/1974 | |
| GB | 2238070 A | * | 5/1991 | E06B 1/56 |

* cited by examiner

*Primary Examiner* — Brian Glessner
*Assistant Examiner* — Jessie Fonseca
(74) *Attorney, Agent, or Firm* — Richards Patent Law P.C.

(57) ABSTRACT

An adjustable garage door jamb trim system includes: an interior door jamb trim; and an exterior door jamb trim, wherein the interior door jamb trim and exterior door jamb trim form an adjustable mating configuration that seal the interface between the interior door jamb trim and the exterior door jamb trim when the interior door jamb trim and exterior door jamb trim are secured to a door jamb having a width between a first width and a second width.

16 Claims, 4 Drawing Sheets

ADJUSTABLE GARAGE DOOR JAMB TRIM

CROSS-REFERENCE TO RELATED APPLICATIONS

This application incorporates by reference and claims priority to U.S. Provisional Patent Application No. 61/620,436 filed Apr. 5, 2012.

BACKGROUND OF THE INVENTION

The present subject matter relates to garage door jamb trim. More specifically, the present subject matter relates to garage door jamb trim that is adjustable, conceals all visible fasteners, is aesthetically pleasing, integrates with exterior siding, includes parts that interoperate with other building jambs, and is fabricated out of durable materials.

Garage door jamb trim protects a garage door jamb from damage that may be caused by rain, snow, insects, etc. Previously existing garage door jamb trim has suffered from several drawbacks. First, some previous garage door jamb trim was constructed from wood that may rot or degrade over time. Second, previous garage door jamb trim was affixed with exposed screws, creating an opening for rainwater to infiltrate the door jamb and cause damage. Further, previous garage door jamb trim lacked aesthetically-pleasing designs. Even further, previous garage door jamb trim was constructed to fit garage door jambs of particular sizes. Finally, previous garage door jamb trim comprised specialized parts only usable as part of garage door jamb trim.

Accordingly, there is a need for garage door jam trim that resists damage, minimizes exposure to the elements and insects, improves aesthetics, and is not limited to a single size of garage door jamb or made of specialized parts only capable of use as part of door jamb trim, as described herein.

BRIEF SUMMARY OF THE INVENTION

The present disclosure provides garage door jamb trim that adjusts to the jamb depth, conceals all visible fasteners, is aesthetically pleasing, integrates with exterior siding, includes parts that interoperate with other building jambs, and is fabricated out of durable materials, by providing garage door jamb trim including at least two pieces that overlap, interleave, and form a substantially snug fit.

In a first example, an interior door jamb trim and an exterior door jamb trim cooperate to provide an adjustable garage door jamb trim that conforms to the varied dimensions of a common garage door jambs. The interior door jamb trim and the exterior door jamb trim overlap to fully cover the garage door jamb when the garage door jamb trim is adjusted to conform to the dimensions of a garage door jamb. Further, the exterior door jamb trim and the interior door jamb trim fit snuggly to provide a seal against the elements. In a preferred embodiment, the garage door jamb trim is adjustable to conform to garage door jambs having a depth between five and one-half inches and seven and one-half inches, though it will be easily understood that the teachings provided herein may be applied to garage door jamb trims of varying sizes.

In the example, the overlap between the interior door jamb trim and the exterior door jamb trim are configured to mate the two portions together. The mating configuration includes an arm of the exterior door jamb trim that mates with a slot in the interior door jamb trim. The mating configuration interleaves the interior door jamb trim and the exterior door jamb trim to create a tortuous path that substantially hinders water from penetrating to the garage door jamb. Further, the mating configuration creates a substantially snug fit to act as a seal against the elements through the use of spacers that hold the arm substantially flush with an inner wall of the interior door jamb trim.

In the example, the interior door jamb trim covers an interior corner of the door jamb (the interior corner of the door jamb includes portions of an interior surface and an exterior door opening surface of the door jamb). Similarly, the exterior door jamb trim covers an exterior corner of the door jamb (the exterior corner of the door jamb includes the remaining portion of the door opening surface and a portion of the exterior external face of the garage doorjamb). Further, in the example, the garage door jamb trim may optionally include a garage door seal to seal an overhead garage door in the closed position.

The interior door jamb trim may be secured by fasteners securing a door opening sealing flange and a front sealing flange to the door jamb. After installation, the fasteners of the door opening sealing flange may be covered by the arm of the exterior door jamb trim. Spacers may be provided on the arm or on the door opening sealing flange to provide clearance for the fasteners when covered by the arm. Likewise, the exterior door jamb trim may be secured by fasteners securing an exterior sealing flange to the vertical height of the exterior corner of the garage doorjamb. Additionally, the exterior door jamb trim may have a decorative face to improve the aesthetic appeal of the garage door jamb.

The optional garage door seal includes a flexible edge to engage the overhead garage door and seal the overhead garage door when it is in the closed position. The interior door jamb trim may include seal retaining grooves to provide an attachment mechanism for the replaceable garage door seal. The garage door seal tabs may be adapted to allow the removal of the garage door seal for easy replacement. In a preferred embodiment, the optional garage door seal may be extruded flexible vinyl. However, it is understood that in various embodiments, the optional garage door seal may be made from other materials and other manufacturing processes.

The garage door jamb trim provided herein may be provided in any one or more of the following further configurations: garage door jamb trim including a siding channel; and garage door jamb trim including an interchangeable decorative trim cover. The additional garage door jamb trim configurations provide different aesthetics and/or integration with the garage door jamb exterior siding.

In another example, the garage door jamb trim includes: an exterior door jamb trim including a siding channel to receive exterior siding providing an aesthetically pleasing garage door jamb.

In a further example, the garage door jamb trim further includes: a decorative trim cover and a clip bracket. The decorative trim cover is an alternative to the decorative face and provides an aesthetically pleasing border to the garage door opening.

The decorative trim cover is secured to the door jamb by snapping into a snap-locking mechanism provided by the relationship between the exterior door jamb trim and the clip bracket. The exterior door jamb trim and clip bracket may be further secured to the door jamb by fasteners securing sealing flanges to the door jamb. The decorative trim cover includes a decorative surface that may have nearly any appearance. The decorative trim cover further includes a siding channel built into the edge of the decorative trim cover to conceal the edge of the adjacent siding. The decorative trim cover may be adapted to interoperate with other trim locations, such as a window jamb.

In instances in which the decorative trim cover is used, an alternative example of the exterior door jamb trim may be provided to assist in securing the decorative trim cover. In such instances, the exterior door jamb trim includes a snap-lock tab in place of the decorative face described above. The snap lock tab engages a retainer tab of the decorative trim cover to secure the decorative trim cover.

The clip bracket operates in conjunction with the exterior door jamb trim to secure the decorative trim cover. The clip bracket includes a socket to receive a tab of the decorative trim cover. The clip bracket is secured to the door jamb by fasteners. The clip bracket may be adapted to interoperate with other trim locations, such as a window jamb.

It is contemplated that the decorative trim cover and the clip bracket may be interoperable and may be further used as window jamb trim. In addition to the socket to receive the decorative trim cover tab, in an alternate window jamb trim example, the clip bracket may include a snap lock tab that engages a retainer tab of the decorative trim cover to secure the decorative trim cover. When installed, the socket of the clip bracket mates with a tab of the decorative trim cover while the snap-lock of the clip bracket mates with the ramp surface and the retainer to secure the decorative trim cover in place. The clip bracket of the alternate window jamb trim example may be trimmed to manufacture a clip bracket for use in the garage door jamb trim by removing the snap-lock tab.

In a preferred embodiment, the interior door jamb trim, the exterior door jamb trim, clip bracket, and decorative trim cover of the garage door jamb trim are manufactured from extruded aluminum. However, it is understood that in various embodiments, the elements of the garage door jamb trim may be made from other materials and other manufacturing processes.

In one example, an adjustable garage door jamb trim system includes: an interior door jamb trim including a first sealing flange, a second sealing flange perpendicular to the first sealing flange, and an inner wall spaced from the second sealing flange to form a slot defined by the second sealing flange and the inner wall; and an exterior door jamb trim including a third sealing flange and an arm perpendicular to the third sealing flange, wherein the arm includes a first spacer; wherein, when the interior door jamb trim is secured to a first corner of a door jamb and the exterior door jamb is secured to a second corner of the door jamb, the arm extends into the slot and the first spacer spans the distance between the second sealing flange and the inner wall, such that the arm is held in contact with the inner wall.

In some embodiments, the exterior door jamb trim includes a decorative face. The decorative face may include a siding channel. The interior door jamb trim may include seal retaining grooves adapted to receive a seal. The arm may include additional spacers.

The adjustable garage door jamb trim system may include a clip bracket adapted to be secured to the door jamb adjacent to the exterior door jamb trim, wherein the clip bracket and exterior door jamb trim are adapted to receive a decorative trim cover. The clip bracket may include a socket for receiving a decorative trim cover tab and the exterior door jamb trim includes a snap-lock tab for mating with a ramp surface and retainer tab of the decorative trim cover. The decorative trim cover includes a siding channel.

In another example, the adjustable garage door jamb trim system includes: an interior door jamb trim; and an exterior door jamb trim, wherein the interior door jamb trim and exterior door jamb trim form an adjustable mating configuration that seal the interface between the interior door jamb trim and the exterior door jamb trim when the interior door jamb trim and exterior door jamb trim are secured to a door jamb having a width between a first width and a second width.

The adjustable mating configuration may be embodied in an arm and slot configuration. In some examples, the difference between the first width and the second width may be two inches. For example, the first width may be five and a half inches and the second width may be seven and a half inches.

In some embodiments, the interior door jamb trim includes an inner wall spaced from a sealing flange to form a slot and the exterior door jamb trim includes an arm including a first spacer. In other embodiments, the exterior door jamb trim includes an inner wall spaced from a sealing flange to form a slot and the interior door jamb trim includes an arm including a first spacer.

The interior door jamb trim may include a first sealing flange, a second sealing flange perpendicular to the first sealing flange, and an inner wall spaced from the second sealing flange to form a slot defined by the second sealing flange and the inner wall; and the exterior door jamb trim includes a third sealing flange and an arm perpendicular to the third sealing flange, wherein the arm includes a first spacer; wherein, when the interior door jamb trim is secured to a first corner of a door jamb and the exterior door jamb is secured to a second corner of the door jamb, the arm extends into the slot and the first spacer spans the distance between the second sealing flange and the inner wall, such that the arm is held in contact with the inner wall. The exterior door jamb trim may include a decorative face, the decorative face may include a siding channel, and the adjustable garage door jamb trim system may include a clip bracket adapted to be secured to the door jamb adjacent to the exterior door jamb trim, wherein the clip bracket and exterior door jamb trim are adapted to receive a decorative trim cover.

An advantage of the invention is that it provides garage door jamb trim that may be adjusted to fit door jambs of varying depth.

Another advantage of the invention is that it provides garage door jamb trim that conceals visible fasteners to minimize exposure of the door jamb to rainwater.

A further advantage of the invention is that it provides an aesthetically pleasing exterior.

Yet another advantage of the invention is that it provides garage door jamb trim that integrates with exterior siding.

An additional advantage of the invention is that it provides garage door jamb trim including parts that interoperate with other building jambs.

Yet a further advantage of the invention is that it provides garage door jamb trim that fabricated out of durable materials.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
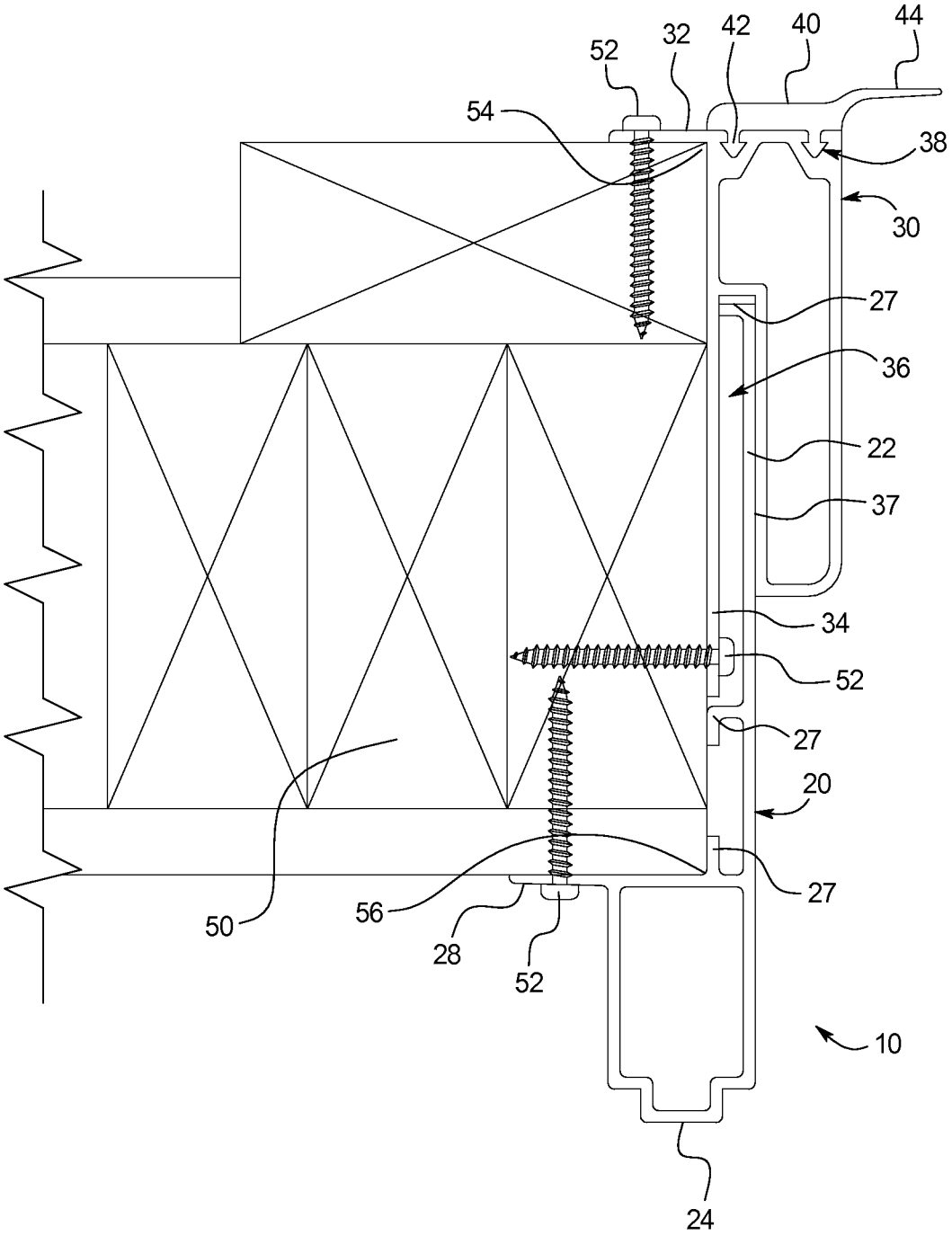
FIG. 1 is a cross-sectional view of a garage door jamb and an example of the garage door jamb trim according to the present invention.
Figure 2:
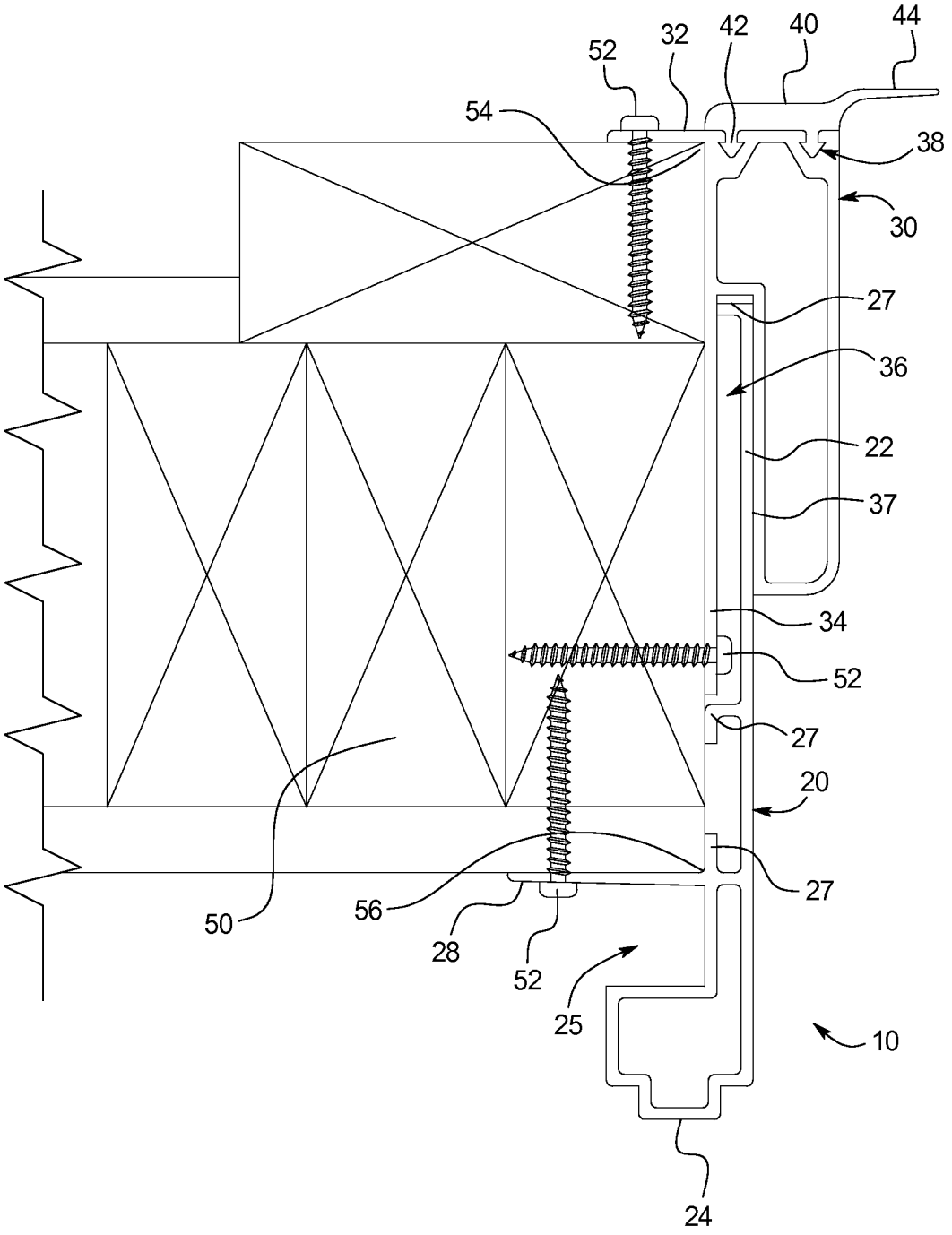
FIG. 2 is a cross-sectional view of a garage door jamb showing another example of the garage door jamb trim including a siding channel.
Figure 3:
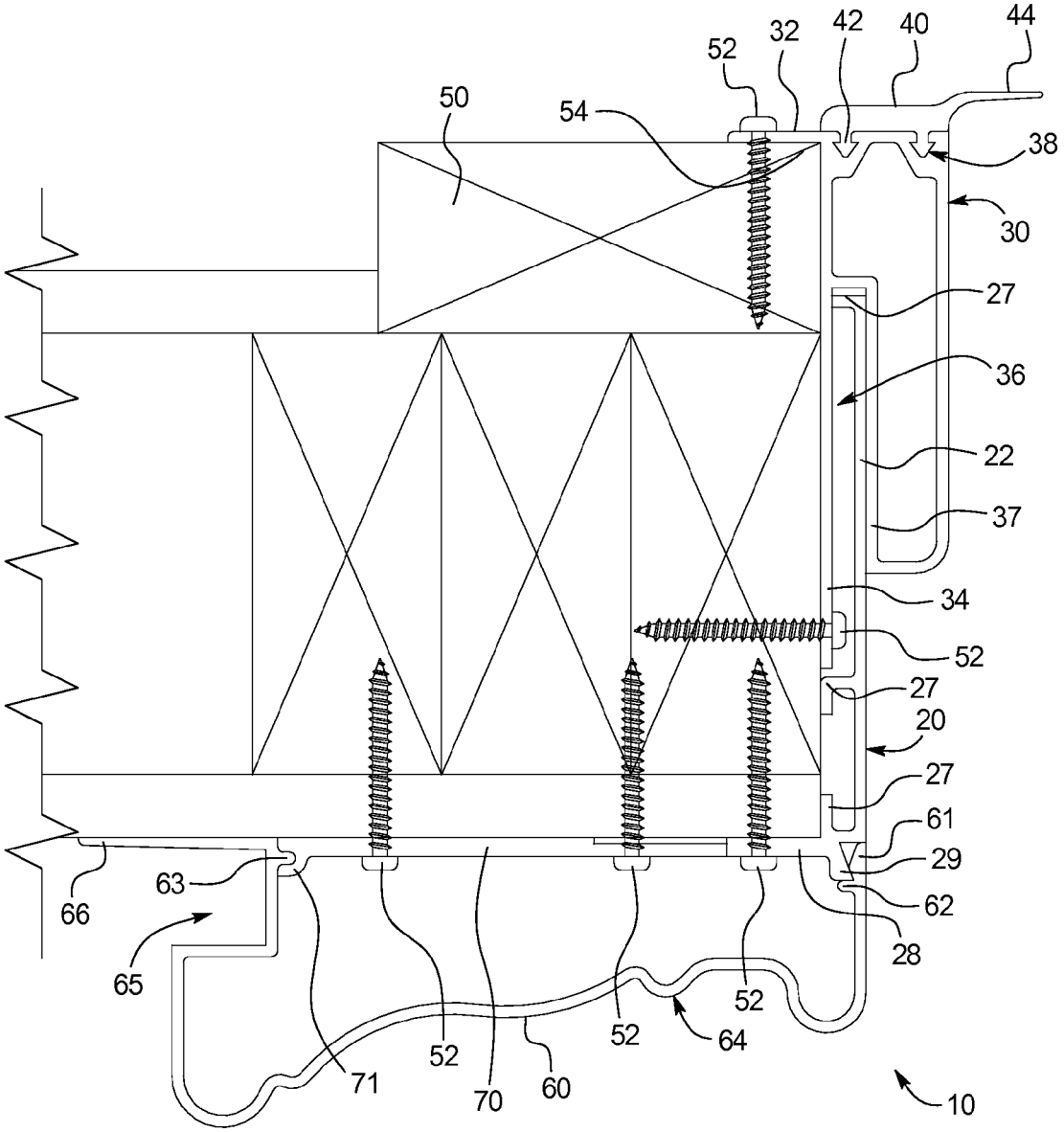
FIG. 3 is a cross-sectional view of a garage door jamb showing another garage door jamb trim including a decorative trim cover.

FIGS. 1-3 illustrate various examples of garage door jamb trim 10 adapted to cover a garage door jamb 50. FIG. 1 illustrates an example of the garage door jamb trim 10 including an exterior decorative face 24. FIG. 2 illustrates an example of the garage door jamb trim 10 including an exterior decorative face 24 and a siding channel 25. FIG. 3 illustrates an example of the garage door jamb trim 10 including a decorative trim cover 60. The garage door jamb trim 10 may be provided in fixed lengths that may be cut to size to match the vertical height of the garage door jamb 50. The examples shown in FIGS. 1-3 are merely illustrative examples of garage door jamb trim 10 that is adapted to provide the solutions taught herein and those skilled in the art will recognize the numerous variations of embodiments that may be implemented based on the teachings disclosed herein.

As shown in FIG. 1, to provide adjustability to enable the garage door jamb trim 10 to conform to the dimensions of a garage door jamb 50, the garage door jamb trim 10 is provided as two pieces: an interior door jamb trim 30 and an exterior door jamb trim 20. In a preferred embodiment, the garage door jamb trim 10 may further include an optional garage door seal 40. The interior door jamb trim 30 is adapted to be secured to the vertical height of the interior corner 54 of the garage door jamb 50. Similarly, the exterior door jamb trim 20 is adapted to be secured to the vertical height of the exterior corner 56 of the garage door jamb 50. It is contemplated that in alternative embodiments the garage door jamb trim 10 may be provided as three or more parts in any configuration capable of providing the adjustability and further advantages preferred for the given application.

In the preferred embodiment shown in FIG. 1, the garage door jamb trim 10 may adjustably conform to garage door jambs 50 of a depth between five and one-half inches and seven and one-half inches. In alternative embodiments, the garage door jamb trim 10 may adjustably conform to garage door jambs 50 of any depth, as those skilled in the art will recognize based on the teachings disclosed herein.

As shown in FIG. 1, the interior door jamb trim 30 and the exterior door jamb trim 20 overlap to fully cover the garage door jamb 50 when the garage door jamb trim 10 is adjusted to conform to the dimensions of a garage door jamb 50. In a preferred embodiment, the overlapping sections are configured to mate the interior door jamb trim 30 and the interior door jamb trim 20. In the example shown in FIG. 1, the mating configuration includes an arm 22 of the exterior door jamb trim 20 that mates with a slot 36 in the interior door jamb trim 30. In an alternative embodiment, the mating of the elements may be reversed. For example, the exterior door jamb trim 20 may include a slot 36 to receive an arm 22 of the interior door jamb trim 10. In addition, while shown as a mating between an arm 22 and a slot 36, the interior door jamb trim 30 and the exterior door jamb trim 20 may take any form appropriate for mating and fully covering the garage door jamb 50, as will be apparent to those skilled in the art based on the disclosures provided herein. For example, rather than an arm 22 and a slot 36, the mating configuration may be embodied in other overlapping elements, such as other forms of overlapping panels.

Further, as shown in FIG. 1, the exterior door jamb trim 20 and the interior door jamb trim 30 interleave to protect the garage door jamb 50 from the elements while maintaining adjustability between the elements. By interleaving the overlapping elements, a tortuous path is created that substantially hinders water from penetrating to the garage door jamb 50. In the preferred embodiment, the arm 22 substantially covers a door opening sealing flange 34 of the interior door jamb trim 30. In turn, an inner wall 37 of the interior door jamb trim 30 covers the arm 22. In other embodiments, the exterior door jamb trim 20 and the interior door jamb trim 30 may have further interleaved components to maintain adjustability while protecting the garage door jamb 50 from the elements, as will be apparent to those skilled in the art based on the disclosures provided herein.

In addition to being overlapping and interleaved, the exterior door jamb trim 20 and the interior door jamb trim 30 have a substantially snug fit to act as a seal against the elements. In the preferred embodiment of FIG. 1, the arm 22 has spacers 27 that hold the arm 22 substantially flush with the inner wall 37 of the interior door jamb trim 30. To meet the objectives and advantages of the invention, the seal between the arm 22 and the inner wall 37 need not form a perfect seal, rather the seal needs only to provide a substantial barrier to the elements. In alternative embodiments, a sealing mechanism, such as compressible foam or a vinyl gasket, may be included in the slot 36 to act as a seal when engaging the arm 22 upon installation. In addition, while shown as a mating between an arm 22 and a slot 36, the interior door jamb trim 30 and the exterior door jamb trim 20 may take any form appropriate to provide the adjustability, protection from the elements and further advantages preferred for the given application.

As shown in FIG. 1, the interior door jamb trim 30 includes an door opening sealing flange 32 and a front sealing flange 34. Fasteners 52 secure the door opening sealing flange 32 and a front sealing flange 34 of the interior door jamb trim 30 to the vertical height of the interior corner 54 of the garage door jamb 50. The interior door jamb trim 30 may further include seal retaining grooves 38 to receive garage door seal tabs 42 to secure garage door seal 40. The retaining grooves 38 and door seal tabs 42 may take many forms as will be recognized by those skilled in the art.

As further shown in FIG. 1, the exterior door jamb trim 20 is secured to the vertical height of the exterior corner 56 of the garage door jamb 50. The exterior door jamb trim 20 may include an exterior sealing flange 28 that may be secured by fasteners 52, and may have a decorative face 24 to improve the aesthetic appeal of the garage door jamb 50.

In the example shown in FIG. 1, the interior door jamb trim 30 and the exterior door jamb trim 20 are secured to the building by a set of fasteners 52. Of course, it is understood that while only three fasteners 52 are shown, a greater number of fasteners 52 will be used along the vertical height of the door jamb 50. In addition, while shown as screws, the fasteners 52 may take any form appropriate for securing the interior door jamb trim 30 to the garage door jamb 50.

In the preferred embodiment shown in FIG. 1, when fully installed, the garage door jamb trim 10 is adapted to hide the fasteners 52 to protect the fasteners 52 and the underlying garage door jamb 50 from the elements. First, fasteners 52 along the interior sealing flange 32 are protected from the elements by the overhead garage door (not shown). Second, fasteners 52 along the front sealing flange 34 are protected by the arm 22. Further, the fasteners 52 along the exterior sealing flange 28 are protected from the elements by the installed siding. In other embodiments, the fasteners 52 may be protected from the elements using any method appropriate to provide the adjustability, protection from the elements, and further advantages preferred for the given application.

The optional garage door seal 40, shown in FIG. 1, seals the space between the door jamb 50 and an overhead garage door, when the garage door is in the closed position. The garage door seal 40 includes a flexible edge 44 to engage the overhead garage door and seal the overhead garage door in the closed position. In an embodiment, the garage door seal 40 further includes the garage door seal tabs 42 to lock into the seal retaining grooves 38 to provide continuous engagement along the length of the interior door jamb trim 30 and permit easy replacement. In other embodiments, the garage door seal 40 may be received by garage door seal tabs 42 that are not continuous and that snap into retainers provided periodically along the length of the interior door jamb trim 30. Further, it is contemplated that the garage door seal 40 and the interior door jamb trim 30 may take any form appropriate for sufficiently securing the garage door seal 40 and permitting easy replacement.

In a preferred embodiment, the garage door seal 40 may be an extruded flexible vinyl. However, it is understood that in various embodiments, the garage door seal may be made from other materials and other manufacturing processes.

FIG. 2 is a cross-section of an embodiment of the garage door jamb trim 10 including an integrated siding channel 25. In the example shown in FIG. 2, the garage door jamb trim 10 includes: an exterior door jamb trim 20; an interior door jamb trim 30; and, optionally, a garage door seal 40. As shown in FIG. 2, the alternative example of the exterior door jamb trim 20 includes the siding channel 25 to receive siding in an aesthetically pleasing manner.

FIG. 3 is a cross-section of the garage door jamb trim 10 having an exterior decorative trim cover 60 installed on the garage door jamb 50. In the example shown in FIG. 3, the garage door jamb trim 10 includes: an exterior door jamb trim 20; an interior door jamb trim 30; an optional garage door seal 40; a decorative trim cover 60; and a clip bracket 70. As shown in FIG. 3, and further described below, the decorative trim cover 60 is secured to the door jamb 50 by snapping into a snap-locking fit to the exterior door jamb trim 20 and the clip bracket 70.

As shown in FIG. 3, the decorative trim cover 60 includes a tab 63 for mating with a socket 71 of the clip bracket 70 and a ramp surface 61 and a retainer tab 62 for mating with the snap-lock tab 29 of the exterior door jamb trim 20. These five elements cooperate to form a secure, releasable, snap-fit connection between the decorative trim cover 60 and the exterior door jamb trim 20 and the clip bracket 70. It is contemplated that in alternative embodiments, the decorative trim cover 60 may be secured to the garage door jamb 50 by other mechanisms, as will be apparent to those skilled in the art based on the disclosures provided herein.

As further shown in FIG. 3, the decorative trim cover 60 has a decorative surface 64 that may be decorative or otherwise adorned, and it is contemplated that nearly any appearance may be provided. The decorative trim cover 60 further includes a siding channel 65 built into the edge of the decorative trim cover 60 to conceal the edge of the siding. The decorative trim cover 60 may be adapted to interoperate with other trim locations, such as a window jamb, as shown in FIG. 3 and described below. Additionally, the decorative trim cover 60 may include a sealing flange 66 to further secure the decorative trim cover 60 in place using fasteners 52, flashing tape, etc.

An alternative example of the exterior door jamb trim 20 is shown in FIG. 3. The exterior door jamb trim 20 includes the snap-lock tab 29 that substitutes for the decorative face 24 of the example shown in FIG. 1. The snap lock tab 29 engages a retainer tab 62 of the decorative trim cover 60 to secure the decorative trim cover 60 as described previously.

Figure 4:
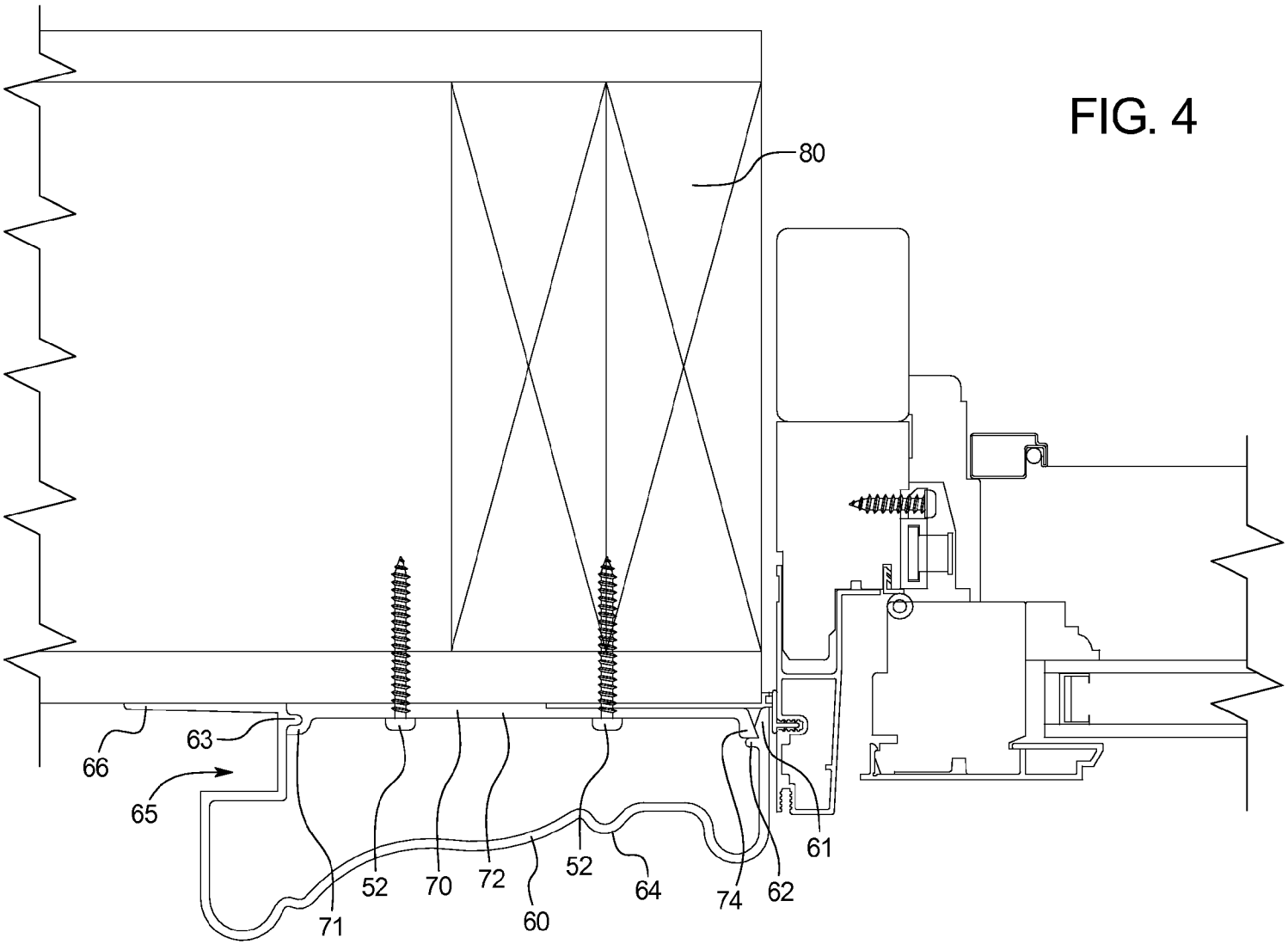
FIG. 4 is a cross-sectional view of a window jamb including the decorative trim cover of FIG. 3, illustrating the interoperability of the decorative trim cover.

As shown in FIG. 3, the clip bracket 70 operates in conjunction with the exterior door jamb trim 20 to secure the decorative trim cover 60. The clip bracket 70 includes the socket 71 to receive the tab 63 of the decorative trim cover 60. The clip bracket 70 is secured by fasteners 52 to the door jamb 50. The clip bracket 70 may be manufactured by trimming off a snap-lock 74 of the alternative clip bracket 72 (FIG. 4). In alternative embodiments, the clip bracket 70 and the exterior door jam trim 20 may be provided as a single component.

In a preferred embodiment, interior door jamb trim 30, the exterior door jamb trim 20, clip bracket 70, and decorative trim cover 60 of the garage door jamb trim 10 are manufactured from extruded aluminum. However, it is understood that in various embodiments, the elements of the garage door jamb trim 10 may be made from other materials and other manufacturing processes. For example, the interior door jamb trim 30, the exterior door jamb trim 20, clip bracket 70, and decorative trim cover 60 of the garage door jamb trim 10 may be made of PVC.

FIG. 4 illustrates a cross-section of a window jamb 80 to show the interoperability of the decorative trim cover 60 and the clip bracket 70. The clip bracket 70 secures the decorative trim cover 60 to the window jamb 80. In the example shown in FIG. 4, the clip bracket 70 is an alternative clip bracket 72 having a socket 71 and a snap-lock 74. When installed, the socket 71 of the clip bracket 70 mates with a tab 63 of the decorative trim cover 60 while the snap-lock 74 of the clip bracket 70 mates with the ramp surface 61 and the retainer 62 to secure the decorative trim cover 60 in place.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. An adjustable garage doorjamb trim system comprising:

an interior door jamb trim including a first sealing flange, a second sealing flange perpendicular to the first sealing flange, and an inner wall spaced from the second sealing flange to form a slot defined by the second sealing flange and the inner wall, wherein the first sealing flange and second sealing flange are flush against a garage doorjamb; and an exterior door jamb trim including a third sealing flange and an arm perpendicular to the third sealing flange, wherein the arm includes at least two spacers, wherein the spacers protrude perpendicular from an inner surface of the arm;

wherein, when the interior door jamb trim is secured to a first corner of the garage door jamb and the exterior door jamb is secured to a second corner of the garage door jamb, the arm and at least one of the spacers extends into the slot and the at least one of the spacers spans the distance between the second sealing flange and the inner surface of the arm, such that a space is maintained between the inner surface of the arm and the second sealing flange and such that an outer surface of the arm is held in contact with the inner wall, wherein the second sealing flange is attached to the garage door jamb by a fastener, wherein a distal end of the fastener is positioned in at least a portion of the space between the second sealing flange and the inner surface of the arm.

2. The adjustable garage door jamb trim system of claim 1 wherein the exterior door jamb trim includes a decorative face.

3. The adjustable garage door jamb trim system of claim 2 wherein the decorative face includes a siding channel.

4. The adjustable garage door jamb trim system of claim 1 wherein the interior door jamb trim includes seal retaining grooves adapted to receive a seal.

5. The adjustable garage door jamb trim system of claim 1 further including a clip bracket adapted to be secured to the door jamb adjacent to the exterior door jamb trim, wherein the clip bracket and exterior door jamb trim are adapted to receive a decorative trim cover.

6. The adjustable garage door jamb trim system of claim 5 wherein the clip bracket includes a socket for receiving a decorative trim cover tab and the exterior door jamb trim includes a snap-lock tab for mating with a ramp surface and retainer tab of the decorative trim cover.

7. The adjustable garage door jamb trim system of claim 6 wherein the decorative trim cover includes a siding channel.

8. The adjustable garage door jamb trim system of claim 1 wherein the fastener includes a head, wherein the head is positioned within the space between the second sealing flange and the inner surface of the arm.

9. An adjustable garage doorjamb trim system comprising:

an interior door jamb trim; and an exterior door jamb trim, wherein the interior door jamb trim and exterior door jamb trim form an adjustable mating configuration that seals the interface between the interior door jamb trim and the exterior door jamb trim when the interior door jamb trim and exterior door jamb trim are secured to a door jamb having a width between a first width and a second width, wherein the adjustable mating configuration is embodied in an arm and slot configuration, wherein the interior door jamb trim includes an inner wall spaced from a second sealing flange to form the slot, wherein the second sealing flange is flush against a garage door jamb, wherein the exterior door jamb trim includes the arm including at least two spacers, wherein the spacers protrude perpendicular from an inner surface of the arm, wherein, when the interior door jamb trim is secured to a first corner of the garage door jamb and the exterior door jamb is secured to a second corner of the garage door jamb, the arm and at least one of the spacers extends into the slot and the at least one of the spacers spans the distance between the second sealing flange and the inner surface of the arm, such that a space is maintained between the inner surface of the arm and the second sealing flange and such that an outer surface of the arm is held in contact with the inner wall, wherein the second sealing flange is attached to the garage door jamb by a fastener, wherein a distal end of the fastener is positioned in at least a portion of the space between the second sealing flange and the inner surface of the arm.

10. The adjustable garage door jamb trim system of claim 9 wherein the difference between the first width and the second width is two inches.

11. The adjustable garage door jamb trim system of claim 9 wherein the first width is five and a half inches and the second width is seven and a half inches.

12. The adjustable garage door jamb trim system of claim 9 wherein the interior door jamb trim includes a first sealing flange, wherein the second sealing flange perpendicular to the first sealing flange; and the exterior door jamb trim includes a third sealing flange, wherein the arm is perpendicular to the third sealing flange.

13. The adjustable garage door jamb trim system of claim 12 wherein the exterior door jamb trim includes a decorative face.

14. The adjustable garage door jamb trim system of claim 13 wherein the decorative face includes a siding channel.

15. The adjustable garage door jamb trim system of claim 12 further including a clip bracket adapted to be secured to the door jamb adjacent to the exterior door jamb trim, wherein the clip bracket and exterior door jamb trim are adapted to receive a decorative trim cover.

16. The adjustable garage door jamb trim system of claim 9 wherein the fastener includes a head, wherein the head is positioned within the space between the second sealing flange and the inner surface of the arm.

* * * * *